US006557611B1

(12) United States Patent
Fuentes

(10) Patent No.: US 6,557,611 B1
(45) Date of Patent: May 6, 2003

(54) SECURITY WINDOW SCREEN

(76) Inventor: Larry Fuentes, 5346 Henty Rd., Avon, NY (US) 14414

( * ) Notice: Subject to any disclaimer, the term of this patent is extended or adjusted under 35 U.S.C. 154(b) by 0 days.

(21) Appl. No.: 09/826,247

(22) Filed: Apr. 4, 2001

(51) Int. Cl.[7] ..... G08B 13/08
(52) U.S. Cl. ..... 160/10; 340/546; 340/545.8
(58) Field of Search ..... 160/10, 372; 340/545.1, 340/546, 545.7, 545.8

(56) References Cited

U.S. PATENT DOCUMENTS 4,495,486 A * 1/1985 White
4,758,824 A * 7/1988 Young
5,103,208 A * 4/1992 Riordan
5,164,705 A * 11/1992 Dunagan et al.
5,594,418 A * 1/1997 Martin
5,604,483 A * 2/1997 Giangardella et al.

OTHER PUBLICATIONS

Sentry Alarm Screens, Sentry Screen Corp., Jun. 20, 2001, www.sentryscreen.com, 4 pages.

* cited by examiner

*Primary Examiner*—Blair M. Johnson
(74) *Attorney, Agent, or Firm*—Greenwald & Basch LLP; Duane C. Basch

(57) ABSTRACT

The present invention is an apparatus for securing a window or similar opening and includes a fair of frames slidably mated to one another. The apparatus further includes one or more sensors or switches that would be triggered in the event that the apparatus is moved or removed, thereby initiating an alarm.

16 Claims, 4 Drawing Sheets

SECURITY WINDOW SCREEN

This invention relates generally to adjustable window screens, and more particularly to an apparatus including, as part of the apparatus, an alarm, for deterring the removal of the apparatus.

COPYRIGHT NOTICE

A portion of the disclosure of this patent document may contain material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND AND SUMMARY OF THE INVENTION

The present invention is directed to a security apparatus that includes an adjustable window or doorway screen and an associated sensor to detect tampering with the screen and an audible security alarm. Individuals have always looked for means to protect one's dwelling from being broken into and burglarized. With the increasing rate of residential burglaries, the problem of protecting one's home, and personal belongings has become of paramount importance. It will be further appreciated, based upon the following disclosure, that the present invention may serve as a safety device when used in windows accessible to children.

In accordance with the present invention, there is provided an adjustable screen apparatus, comprising: an adjustable framework, wherein said framework may be adjusted relative to a space defined by opposing sides of an opening; a perforated member associated with said framework; at least one sensor for detecting the displacement of the framework relative to the opening; and an alarm, responsive to the sensor, for generating a human perceptible output upon displacement of the section.

In accordance with another aspect of the present invention, there is provided an adjustable screen apparatus, comprising: an adjustable framework of two slidably mated sections, wherein said sections may be adjusted relative to one another so as to fit within an opening defined by a window frame and at least one movable sash therein; a ventilation screen member associated with each of said framework sections; at least one sensor for detecting the displacement of at least one of the framework sections relative to the opening; and an alarm, responsive to the sensor, for generating a human perceptible output upon displacement of the section.

In accordance with yet another aspect of the present invention, there is provided a removable and adjustable window screen apparatus, comprising: an adjustable framework having at least two slidably mated sections, wherein said sections may be adjusted relative to one another in a longitudinal direction so as to allow the screen to fit within a space defined by opposing sides of a window frame; a ventilation screen member associated with each of said framework sections, at least one sensor for detecting the displacement of at least one of the framework sections relative to the opening; and an alarm, responsive to the sensor, for generating a human perceptible output upon displacement of the section.

One aspect of the invention deals with a basic problem in the use of portable or removable screens or barriers—the removal of such screens and barriers often is undetected.

This aspect is further based on the discovery of a technique that alleviates this problem. The technique provides an alarm feature, associated with the screen or barrier, where removal or event tampering with the apparatus results in the generation of an audible and/or visual alarm. This aspect is further based on the discovery of techniques that can easily implement the alarm feature without significantly increasing the expense of such units.

Figure 1:
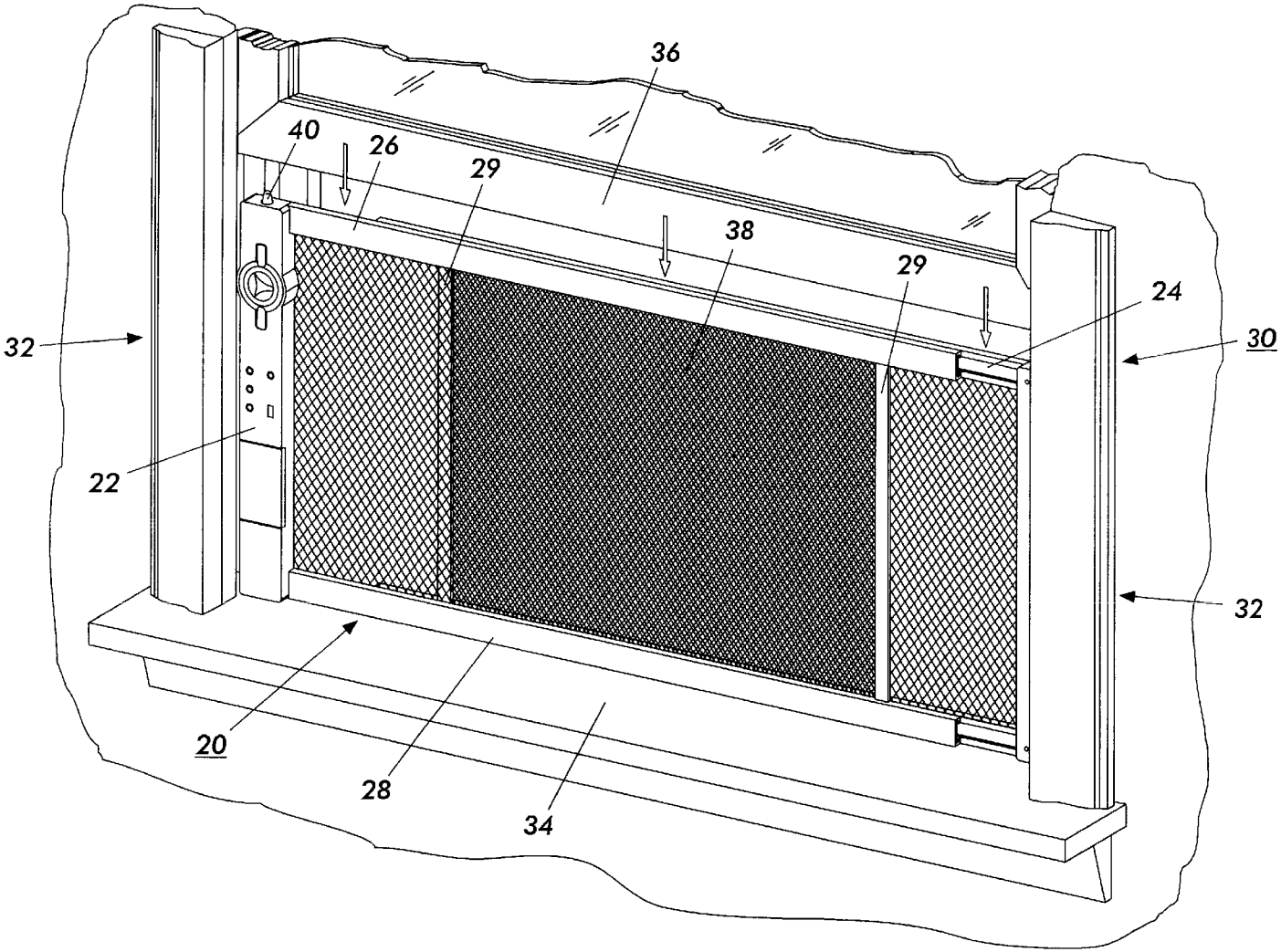
FIGS. 1 and 2 are perspective views of an embodiment of the present invention installed within a sash-type window.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description.

"Window" is intended to represent a fenestration or similar architectural feature that includes a transparent or translucent region, glazing or opening therein. A window generally includes a frame or similar structural member in which the window slides (e.g., sash-type window), is fixed, opens/closes or pivots (e.g., casement windows). Windows may be incorporated within permanent structures (dwelling, buildings, etc.) as well as temporary or transportable structures (trailers, recreational vehicles, temporary buildings, etc.). As described herein, the present invention has application other than use in windows.

Figure 2:
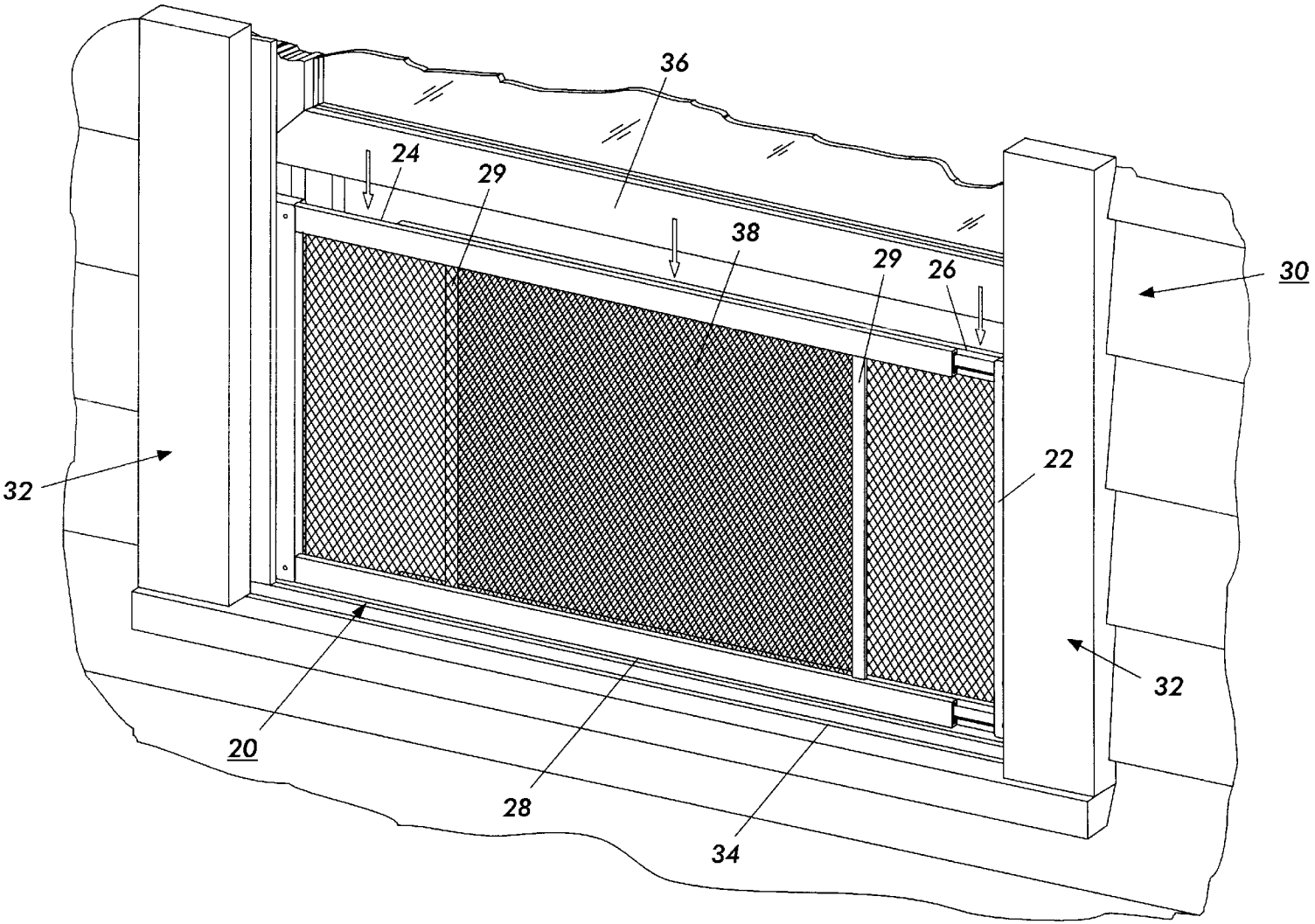

Referring now to FIGS. 1 and 2, there are depicted, respectively, inside and outside views of an embodiment of the present invention in association with a sash-type window opening 30. It will, however, be appreciated that aspects of the present invention are applicable to screen assemblies that might be used on windows other than the sash-type window depicted and used as the exemplary application disclosed herein. As depicted in the figures, apparatus 20 includes a pair of frames 22 and 24 that are slidably mated with one another. Frames 22 and 24 may be made from metal, plastic or similar materials, or a combination thereof. More specifically, the upper and lower members 26 and 28 of each frame include features that allow the members to slide relative to their respective mating member along the longitudinal axis thereof, but prevent separation of the members from one another. It will be appreciated that numerous configurations or cross-sections of the upper and lower members may be employed to accomplish such a feature, and reference is made to known adjustable screen apparatus as are commercially available. Furthermore, each end of the upper and lower members is maintained in a spaced-apart fashion by frame ends 29.

As depicted in FIGS. 1 and 2, the screen is used by placing it into a window 30 having a frame consisting of side jambs 32, head jamb (not shown) and sill 34 with the sash 36 raised. The screen members are slideably expanded to the width of the side jambs, preferably locating the outer sides of the frames within tracks or channels found in the side jambs. Once the apparatus is adjusted to the width of the window, the sash may be lowered so as to come into contact with the apparatus 20, where one or more spring-loaded contact switches or similar sensors are depressed. It will be appreciated that removal of the apparatus is accomplished by reversing the above-described installation steps.

Figure 4:
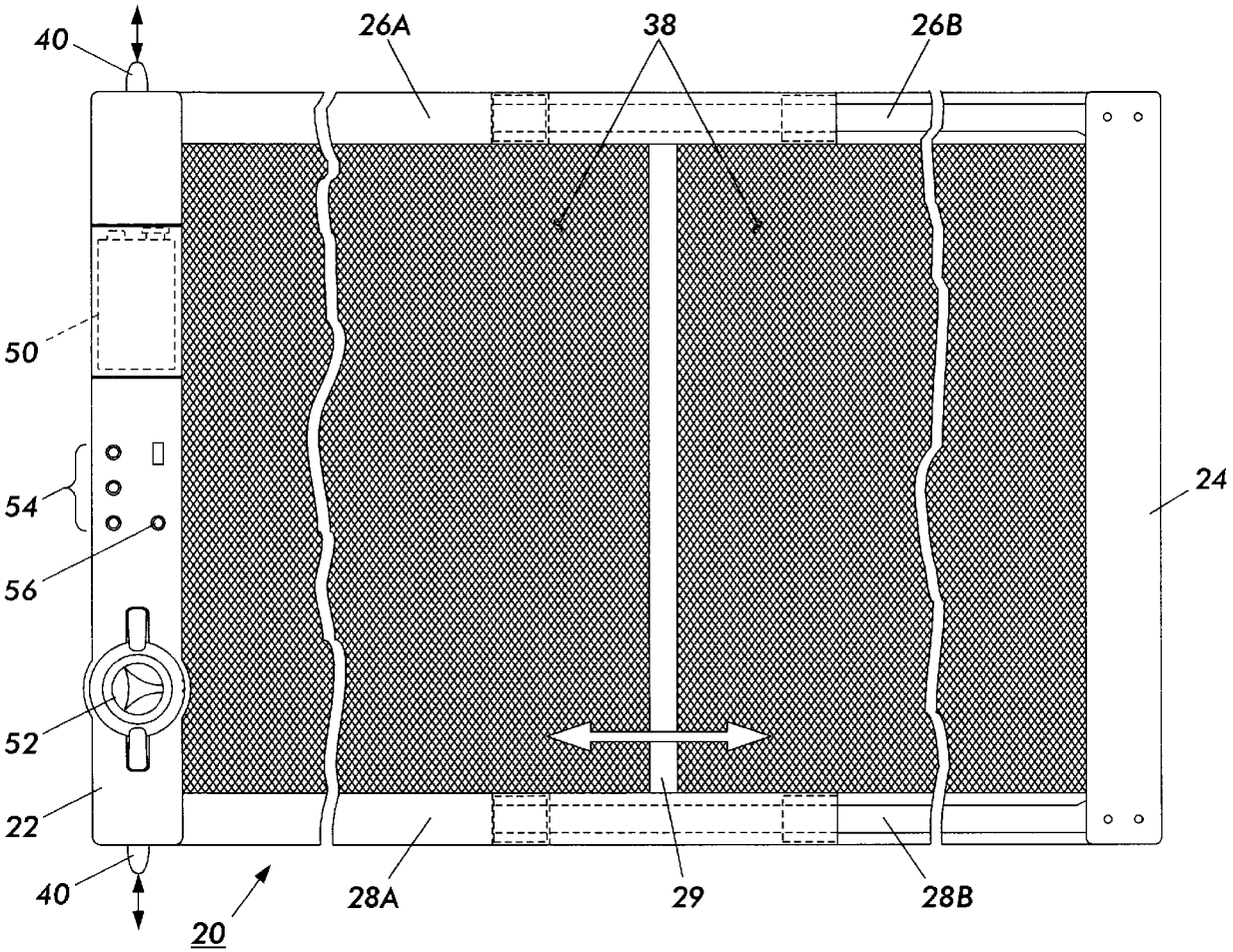
FIGS. 3 and 4 are orthogonal views of an embodiment of the invention as depicted in FIGS. 1 and 2.
Figure 3:
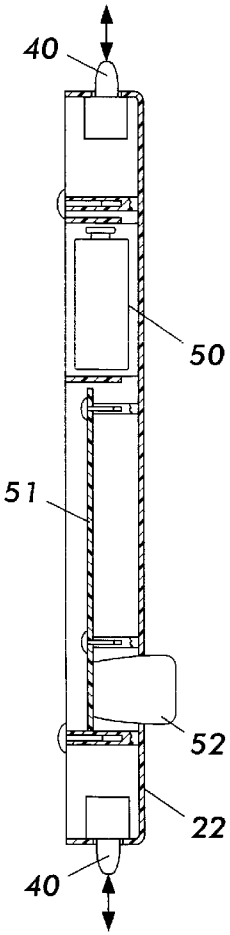
Figure 5:
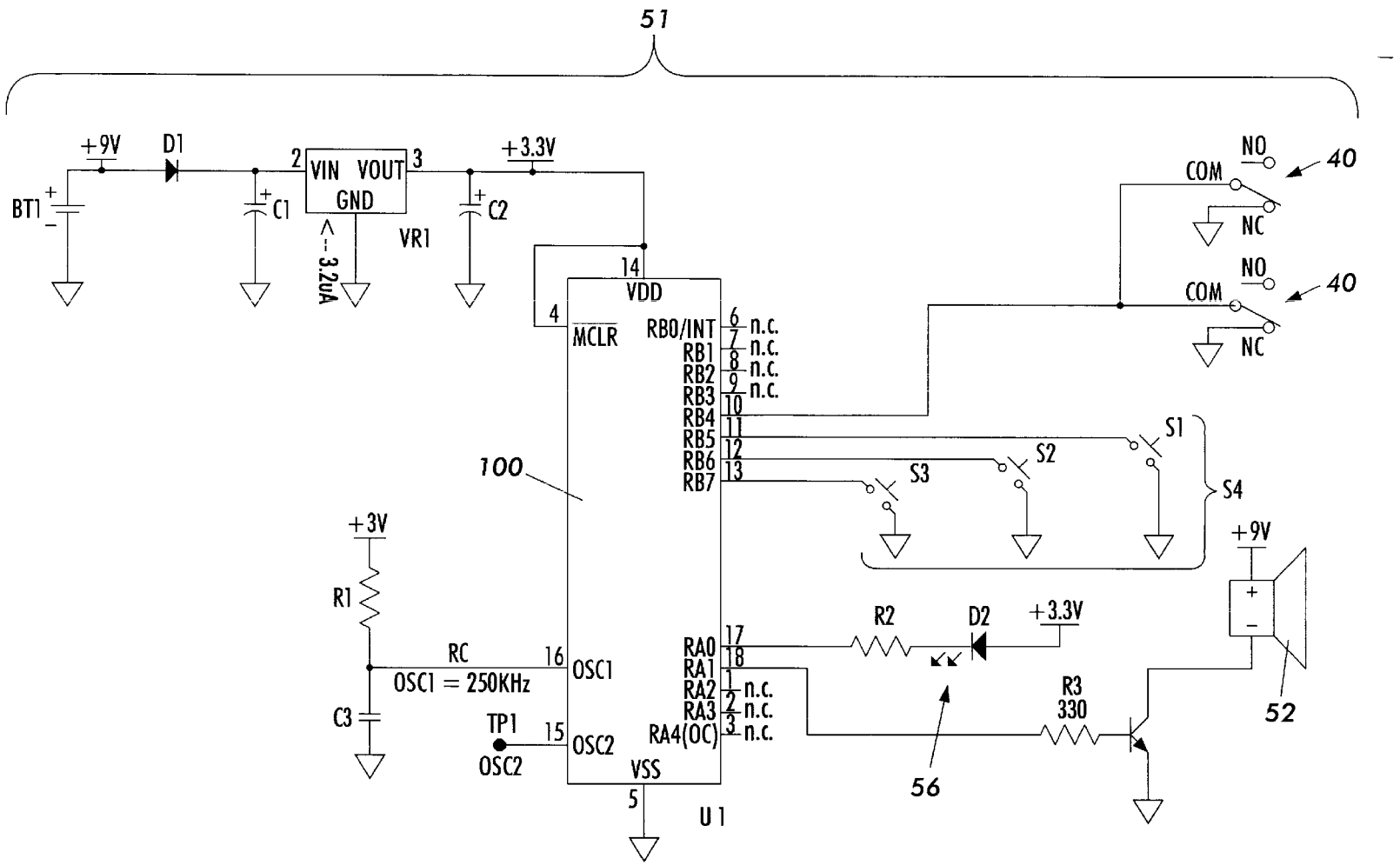
FIG. 5 is an exemplary schematic block diagram of the electrical components used to implement the sensor and alarm aspects of the present invention.

Having described the use and installation of the adjustable screen, attention is now turned to FIGS. 3 and 4 where, in conjunction with FIGS. 1 and 2, the security aspects of the screen will be described. In particular, FIG. 3 and the left side of FIG. 4 illustrate the details of inner frame 22. Inner frame 22 includes not only a rectangular shaped frame having upper and lower members 26*a* and 28*a* and a screen material 38 strung therebetween, but a security feature as well. The security feature comprises a self-contained power supply or battery 50, a speaker 52, a sensor or switch 40 and one or more security code entry or programming mechanisms in the form of buttons 54, as well as at least one indicator light 56, all of which are controlled by a programmable microcontroller as part of alarm circuit 51 (FIG. 5).

Outer frame 24 preferably includes a rectangular frame with upper and lower members 26*b* and 28*b*, and a screen material 38 strung therebetween. However, while it is possible to include the various security features in frame 24, it is presently believed that a preferred embodiment of the apparatus includes such features in only one of the frames, the inside frame 22 so as to limit cost.

Once installed in the window, apparatus 20 not only allows for ingress/egress of air through the screened region 38, but also monitors whether the apparatus is moved or removed from the window. For example, if the sash 36 is raised so as to allow switch 40 to extend back to its nominal (closed) position, the switch would complete a trigger or similar circuit, indicating that the screen had been moved. In a simple version, the apparatus may be "armed" or placed in the mode of sensing movement of the screen or window by simply turning a switch on. In the embodiment depicted in the figures, a three-button "keypad" 54 is employed to place the system into the "armed" mode. For example, a series of three or more pre-selected button-pushes must be used to "arm" and/or "disarm" the apparatus. The use of the programmable button feature further prevents tampering with the alarm feature, whether by youngsters or intruders. Indicator light 56, preferably a light-emitting diode (LED) indicates that the apparatus is in the "armed" mode by a continuous or blinking light.

While the apparatus may be pre-programmed for a particular button-push sequence to arming or disarming the alarm, it is preferable that the alarm feature be independently programmable by a user. Thus, the device may be placed in a "programming" mode, where a user may select the button-push sequence he/she desires for the screen. Thus a user may utilize one or more of the systems with common or distinct programming sequences.

As depicted in the various figures, the system includes sensors or switches 40 at the top and bottom of frame 22. It will be further appreciated that alternative or additional sensors may be employed, including, for example:

- a side-mounted switch to sense a separation between the side of frame 22 or 24 and the side jamb,
- a sensor (wire) to detect cutting or removal of the screen from the frame,
- a contact switch to detect the movement of frame 22 relative to frame 24; and/or
- a battery or component-tampering sensor that would signal removal of the battery cover, or even repeated entry of incorrect codes (e.g., tampering by a young child).

It will be further appreciated that the programming and response features of the present invention may be implemented via a microcontroller or similar digital logic device 100 as depicted, for example, in FIG. 5. Referring to FIG. 5, the schematic diagram illustrates the various electrical components of an embodiment of the present invention. In particular, the components include a battery or similar power supply 50, one or more sensors or switches 40, a microcontroller 100, programming keypad with buttons 54, an indicator light(s) 56, a speaker 52 (powered by an oscillating output of microcontroller 100). As an option, the system may further include additional sensors or switches as described above, or it may include an alternative or additional alarm in the form of a light (not shown) which may be a flashing or strobing light.

The following is a list of parts employed in the embodiment of the present invention as depicted in FIG. 5:

| QTY | REF | PART NUMBER | DESCRIPTION | MANUFACTURER |
|---|---|---|---|---|
| 1 | U1 | PIC16C554-04/P | 8-Bit Microcontroller OTP 512 × 14 EPROM, 80 × 8 RAM | Microchip |
| 1 | VR1 | TC55RP3302EZB | Regulator 3.3V @ 250 mA | TELCOM |
| 1 | D1 | 1N4148 | Small signal diode | Diodes Inc. |
| 1 | D2 | HLMP-1700QT | Red LED (T-1) | QT Optoelectronics |
| 1 | Q1 | 2N3904 | Small signal Transistor NPN | Motorola |
| 1 | R1 | — | 47K Ohm Res. 5% 1/4 W | Yageo |
| 2 | R2,R3 | — | 330 Ohm Res. 5% 1/4 W | Yageo |
| 1 | C1 | ECU-S1H101JCA | 100 pF 50 V Ceramic Cap. 0.1" lead spacing, X7R | Panasonic |
| 2 | C1-C2 | ECS-F1CE105K | 1 uF, 16 V Tantalum Cap. 0.1" lead spacing | Panasonic |
| 3 | S1-S3 | EVQ-PAC04M | Momentary pushbutton SPST | Panasonic |
| 2 | S4,S5 | E69-00A | Momentary switch SPDT | Cherry |
| 1 | SDR1 | PS-953 | 105 dB Siren (6–14 Vdc) | Mallory |
| 1 | BT1 | — | 9 V alkaline battery | Eveready |
| 1 | (BT1) | — | 9V alkaline battery Snap | Eagle |

Microcontroller 100 may be any suitable programmable logic device capable of handling the limited functions described herein, such as an 8-bit microcontroller (Microchip Part No. PIC16C554-04/P). Controller 100 is preferably a low power device capable of receiving inputs from one or more sensors or switches 40 and push-button switches or keypads 54, which themselves may need to be processed (e.g., debouncing) so as to provide meaningful signals. Furthermore, controller 100 may include programmable outputs, include the ability to control and/or drive the speaker or light, thereby eliminating the need for an oscillating frequency generator 60.

In particular, microcontroller 100 preferably operates under the control of software, an exemplary portion of which is disclosed in the following partial assembly language instruction listing from the "main.asm" program:

```
MAIN                                ;got here due to POR or wake up!
    CALL        INITIALIZE          ;setup all port pins as outputs and
                                    ;all pins low & portB pull-ups on
    BCF         PORTA,RA0           ;turn on the led . . .
    BTFSS       PORTB,RB4           ;ck if the screen in a window
    GOTO        SLEEP_MODE          ;put to sleep, can't arm if not in
                                    ;window with both plungers in!
CK_TO_ARM
    MOVLW       01H                 ;pre-reload counter for 1st blink
    MOVWF       BLINK               ;armed light interval counter
    CALL        KEY_SCAN            ;scan the keys and ck for valid code
                                    ;FLAGS,CODE = 1 for valid code
    BTFSS       FLAGS,CODE          ;ck for valid code
    GOTO        SLEEP_MODE          ;go to sleep, not valid arming code
NOW_ARMED
    DECFSZ      BLINK               ;dec the blink counter
    GOTO        NO_BLINK            ;skip the led blink
    BCF         PORTA,RA0           ;turn on the led
    CALL        DELAY_25mS          ;25mS delay
    BSF         PORTA,RAO           ;turn OFF the led
    MOVLW       50H                 ;reload counter
    MOVWF       BLINK               ;armed light interval counter
NO_BLINK
    CALL        DELAY_25mS          ;25mS delay
    CALL        KEY_SCAN            ;scan the keys and ck for valid code
                                    ;FLAGS,CODE = 1 for valid code
    BTFSC       FLAGS,CODE          ;ck for valid code
    GOTO        SLEEP_MODE          ;disarm the screen
    BTFSS       PORTB,RB4           ;ck if the screen in a window
    GOTO        ALARMED             ;one of the window switches is out
    GOTO        NOW_ARMED           ;keep looping in armed state
;-----------------------------------------------
ALARMED                             ;one of win switches closed!
    MOVLW       00H                 ;pre-reload counter for siren length
    MOVWF       BLINK
SIREN_LOOP
    BSF         PORTA,RA1           ;turn ON the SIREN
    BCF         PORTA,RA0           ;turn on the led
    CALL        DELAY_25mS          ;delay
    BSF         PORTA,RA0           ;turn off the led
    CALL        DELAY_25mS          ;delay
    CALL        DELAY_25mS          ;delay
    CALL        KEY_SCAN            ;scan the keys and ck for valid code
                                    ;FLAGS,CODE = 1 for valid code
    BTFSC       FLAGS,CODE          ;ck for valid code
    GOTO        SLEEP_MODE          ;disarm the screen
    BCF         PORTA,RA0           ;turn on the led
    CALL        DELAY_25mS          ;delay
    BSF         PORTA,RA0           ;turn off the led
    CALL        DELAY_25mS          ;delay
    CALL        DELAY_25mS          ;delay
    CALL        KEY_SCAN            ;scan the keys and ck for valid code
                                    ;FLAGS,CODE = 1 for valid code
    BTFSC       FLAGS,CODE          ;ck for valid code
    GOTO        SLEEP_MODE          ;disarm the screen
    BCF         PORTA,RA0           ;turn on the led
    CALL        DELAY_25mS          ;delay
    BSF         PORTA,RA0           ;turn off the led
    CALL        DELAY_25mS          ;delay
    CALL        DELAY_25mS          ;delay
    CALL        KEY_SCAN            ;scan the keys and ck for valid code
                                    ;FLAGS,CODE = 1 for valid code
    BTFSC       FLAGS,CODE          ;ck for valid code
    GOTO        SLEEP_MODE          ;disarm the screen
    BCF         PORTA,RA0           ;turn on the led
    CALL        DELAY_25mS          ;delay
    BSF         PORTA,RA0           ;turn off the led
    CALL        DELAY_25mS          ;delay
```

-continued

```
    CALL        DELAY_25mS      ;delay
    CALL        KEY_SCAN        ;scan the keys and ck for valid code
                                ;FLAGS,CODE = 1 for valid code
    BTFSC       FLAGS,CODE      ;ck for valid code
    GOTO        SLEEP_MODE      ;disarm the screen
    BCF         PORTA,RA0       ;turn on the led
    CALL        DELAY_25mS      ;delay
    BSF         PORTA,RA0       ;turn off the led
    CALL        DELAY_25mS      ;delay
    CALL        DELAY_25mS      ;delay
    CALL        KEY_SCAN        ;scan the keys and ck for valid code
                                ;FLAGS,CODE = 1 for valid code
    BTFSC       FLAGS,CODE      ;ck for valid code
    GOTO        SLEEP_MODE      ;disarm the screen
    DECFSZ      BLINK           ;dec the blink counter
    GOTO        SIREN_LOOP      ;keep looping with siren on
    GOTO        SLEEP_MODE      ;disarm the screen - siren timeout
;-----------------------------------------------
KEY_SCAN                        ;scan the keys and ck for valid code
    BCF         FLAGS,CODE      ;invalid code indicator
CK_1ST_KEY                      ;ck for "1"
    BTFSS       PORTB,RB5       ;ck if key "1" is pressed
    GOTO        CK_2ND_KEY      ;key "1" is pressed
    GOTO        END_KEY_SCAN
CK_2ND_KEY
    BTFSS       PORTB,RB6       ;ck if key "2" is pressed
    GOTO        END_KEY_SCAN
    BTFSS       PORTB,RB7       ;ck if key "3" is pressed
    GOTO        END_KEY_SCAN
    CLRF        TIMEOUT         ;key timeout counter
WAIT_NO_KEY1                    ;wait for no keys pressed
    CALL        DELAY_25mS      ;delay 25mS
    COMF        PORTB,W         ;read the inverted switches
    ANDLW       11100000B       ;mask off non-keys
    BTFSC       STATUS,2        ;ck if the zero bit is set
    GOTO        NO_KEYS1        ;no keys are pressed
    DECFSZ      TIMEOUT         ;wait only 6.4 sec for no key
    GOTO        WAIT_NO_KEY1
    GOTO        END_KEY_SCAN    ;key timer expired
NO_KEYS1
    CALL        DELAY_25mS      ;delay 25mS
    BTFSS       PORTB,RB5       ;ck if key "1" is pressed
    GOTO        END_KEY_SCAN
    BTFSS       PORTB,RB7       ,ck if key "3" is pressed
    GOTO        END_KEY_SCAN
    BTFSS       PORTB,RB6       ;ck if key "2" is pressed
    GOTO        CK_3RD_KEY      ;key "2" is pressed
    DECFSZ      TIMEOUT         ;wait rest of 6.4 sec for key2
    GOTO        NO_KEYS1
    GOTO        END_KEY_SCAN    ;key timer expired
CK_3RD_KEY
    BTFSS       PORTB,RB5       ;ck if key "1" is pressed
    GOTO        END_KEY_SCAN
    BTFSS       PORTB,R87       ;ck if key "3" is pressed
    GOTO        END_KEY_SCAN
WAIT_NO_KEY2                    ;wait for no keys pressed
    CALL        DELAY_25mS      ;delay 25mS
    COMF        PORTB,W         ;read the inverted switches
    ANDLW       11100000B       ;mask off non-keys
    BTFSC       STATUS,2        ;ck if the zero bit is set
    GOTO        NO_KEYS2        ;no keys are pressed
    DECFSZ      TIMEOUT         ;wait for rest of 6.4 sec for no key
    GOTO        WAIT_NO_KEY2
    GOTO        END_KEY_SCAN    ;key timer expired
NO_KEYS2
    CALL        DELAY_25mS      ;delay 25mS
    BTFSS       PORTB,RB5       ;ck if key "1" is pressed
    GOTO        END_KEY_SCAN
    BTFSS       PORTB,RB6       ;ck if key "2" is pressed
    GOTO        END_KEY_SCAN
    BTFSS       PORTB,RB7       ;ck if key "3" is pressed
    GOTO        VALID_CODE      ;key "3" is pressed
    DECFSZ      TIMEOUT         ;wait rest of 6.4 sec for key3
    GOTO        NO_KEYS2
    GOTO        END_KEY_SCAN    ;key timer expired
VALID_CODE                      ;"1" "2" "3" was entered
    BSF         FLAGS,CODE      ;valid code indicator
    BSF         PORTA,RA0       ;turn off the led
. . .
```

-continued

```
    BCF         PORTA,RA0        ;turn on the led
...
    BSF         PORTA,RA0        ;turn off the led
...
    BCF         PORTA,RA0        ;turn on the led
...
    BSF         PORTA,RA0        ;turn off the led
END_KEY_SCAN
    RETURN                       ;return from sub-routine
;-----------------------------------------------
    GOTO        SLEEP_MODE       ;put to sleep - if lost
```

From the description above, it will be appreciated that the present invention may be employed not only as a ventilation device, but also as a barrier, where movement or removal of the device results in an audible and/or visual alarm. For example, the present invention may also find particular use as an alarmed child safety gate, whereby a child's tampering would cause the alarm to sound. In such an embodiment, the apparatus would further include a spring or similar mechanism to assure that the apparatus is retained within a doorway or similar location.

In recapitulation, the present invention is an apparatus for securing a window or similar opening through which a person might pass, and includes a pair of frames slidably mated to one another. The apparatus further includes one or more sensors or switches that would be triggered in the event that the apparatus is moved or removed, thereby initiating an alarm.

It is, therefore, apparent that there has been provided, in accordance with the present invention, an adjustable window or doorway screen and an associated sensor to detect tampering with the screen and an audible security alarm. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An adjustable screen apparatus, comprising:

an adjustable framework, wherein said framework may be adjusted relative to a space defined by opposing sides of an opening;

a perforated member associated with said framework;

at least one sensor, enclosed within said adjustable framework so as to be substantially hidden from view, for detecting the displacement of the framework relative to the opening; and an alarm, also enclosed within said adjustable framework so as to be substantially hidden from view, said alarm being responsive to the sensor, for generating a human perceptible output upon displacement of the section.

2. The apparatus of claim 1, further comprising:

a self-contained power source; and security code entry device for canceling said alarm once said sensor has detected the displacement of the framework.

3. The apparatus of claim 2, wherein said security code entry device is programmable by a user.

4. The apparatus of claim 2, wherein said self-contained power source is a battery.

5. The apparatus of claim 1, wherein the opening is a sash-type window having a frame in which a window sash travels, and where the adjustable framework is adjustable to fit within the window frame in a space defined by the window frame and a window sash.

6. The apparatus of claim 5, wherein the apparatus includes a first sensor for detecting displacement of the framework relative to the window frame and a second sensor for detecting displacement of the window sash relative to the framework.

7. An adjustable screen apparatus, comprising:

an adjustable framework of two slidably mated sections, wherein said sections may be adjusted relative to one another so as to fit within an opening defined by a window frame and at least one movable sash therein;

a ventilation screen member associated with each of said slidably mated sections;

at least one sensor, enclosed within said adjustable framework so as to be substantially hidden from view, for detecting the displacement of at least one of the framework sections relative to the opening; and an alarm, also enclosed within said adjustable framework so as to be substantially hidden from view, said alarm being responsive to the sensor, for generating a human perceptible output upon displacement of the section.

8. The adjustable screen apparatus of claim 7, further comprising:

a self-contained power source; and security code entry mechanism for canceling said alarm once said sensor has detected the displacement of at least one of the framework sections.

9. The apparatus of claim 8, wherein said security code entry mechanism is programmable by a user.

10. A removable and adjustable window screen apparatus, comprising:

an adjustable framework having at least two slidably mated sections, wherein said sections may be adjusted relative to one another in a longitudinal direction so as to allow the screen to fit within a space defined by opposing sides of a window frame;

a ventilation screen member associated with each of said framework sections, at least one sensor, enclosed within at least one of said adjustable framework sections so as to be substantially hidden from view, for detecting the displacement of at least one of the framework sections relative to the opening; and an alarm, also enclosed within at least one of said adjustable framework sections so as to be substantially hidden from view, said alarm being responsive to the sensor, for generating a human perceptible output upon displacement of the section.

11. The removable and adjustable window screen apparatus of claim 10, further comprising:

a self-contained power source; and security code entry mechanism for canceling said alarm once said sensor has detected the displacement of the framework section.

12. The removable and adjustable window screen apparatus of claim 11, wherein said security code entry mechanism is programmable by a user.

13. The removable and adjustable window screen apparatus of claim 12, wherein said security code entry mechanism includes:

at least three push-button switches; and a programmable microcontroller, responsive to said push-button switches, for detecting the order on which said push-button switches are depressed by a user.

14. The removable and adjustable window screen apparatus of claim 10, wherein the apparatus includes a first sensor for detecting displacement of the framework relative to the window frame and a second sensor for detecting displacement of the window sash relative to the framework.

15. The removable and adjustable window screen apparatus of claim 14, wherein the alarm may not be set unless the first sensor and the second sensor are in an open state.

16. The removable and adjustable window screen apparatus of claim 15, further comprising an indicator light to indicate when the alarm is in an armed mode.

* * * * *